United States Patent [19]

Hansen

[11] Patent Number: 5,046,299

[45] Date of Patent: Sep. 10, 1991

[54] METHOD IN PREPARING DIRECT MAIL ADVERTISING PARCELS

[76] Inventor: Bill Hansen, Österportagatan 2 A, S-211 28 Malmö , Sweden

[21] Appl. No.: 462,722

[22] Filed: Oct. 6, 1989

[51] Int. Cl.[5] ..... B65H 3/08; B41L 45/00

[52] U.S. Cl. ..... 53/411; 53/460; 53/266.1

[58] Field of Search ..... 53/411, 460, 429, 435, 53/266 A, 206, 469, 77, 569

[56] References Cited

U.S. PATENT DOCUMENTS

| | | | |
|---|---|---|---|
| 3,983,679 | 10/1976 | Zemke | 53/460 X |
| 4,065,117 | 12/1977 | Thorsheim | 270/58 |
| 4,484,733 | 11/1984 | Loos et al. | 53/411 X |
| 4,571,925 | 2/1986 | Adams | 53/266 A X |
| 4,784,379 | 11/1988 | Vander Syde et al. | 53/266 A X |
| 4,798,040 | 1/1989 | Haas et al. | 53/266 A X |
| 4,817,368 | 4/1989 | De Pasquale et al. | 53/460 |

FOREIGN PATENT DOCUMENTS

| | | |
|---|---|---|
| 486120 | 11/1929 | Fed. Rep. of Germany . |
| 717355 | 10/1931 | France . |
| 556747 | 10/1974 | Switzerland . |
| 2139176 | 11/1984 | United Kingdom . |
| 2177346 | 1/1987 | United Kingdom . |

*Primary Examiner*—James F. Coan

*Attorney, Agent, or Firm*—Nils H. Ljungman & Associates

[57] ABSTRACT

Method in preparing parcels for direct mail advertising comprising printed papers from several different senders in one and the same envelope. For each individual addressee there is provided a set of a predetermined number of individual and separate printed papers of one and the same size, the number being the same for all sets. Each printed paper of one and the same set is provided with printed information personified as regards the actual addressee. All printed papers of a set are laid one upon the other and then all sets are stacked. Each set is picked in its entirety from the stack, and each set thus picked is inserted into an envelope addressed to the addressee personified in the set.

7 Claims, 2 Drawing Sheets

METHOD IN PREPARING DIRECT MAIL ADVERTISING PARCELS

CONTINUING APPLICATION INFORMATION

The present U.S. application is a continuation-in-part of International Patent Application No. PCT/SE88/00170, filed on Apr. 7, 1988, which is, in turn, based on Swedish Patent Application No. 8701447-8 filed on Apr. 7, 1987.

BACKGROUND OF THE INVENTION

1. Field of the Invention

The invention relates to a method for preparing direct mail advertising parcels or envelopes containing, in one and the same envelope, printed papers from several different senders.

2. Description of the Prior Art

In such direct mail advertising parcels, as prepared today, the printed paper from only one of the senders of each parcel may be personified with regard to the addressee, i.e., it addresses itself to the addressee by including a letter, addressed to the addressee in person, a benefit ticket drawn on the addressee, or the like. The other printed papers included in the parcel are not personified with regard to the addressee; they comprise anonymous printed papers. Another type of direct mail advertising from several senders comprise the arrangement of the printed papers from all senders in a booklet, the name of the addressee possibly being mentioned on the first page of the booklet, such that the sender responsible for that side of the booklet has personified the receiver, but in most cases the name of the receiver is not at all mentioned in the booklet.

Direct mail advertising is expensive advertising, and it is therefore a natural measure from an economic point of view that several senders agree upon using one and the same parcel or envelopes in order to reduce the postage. This can be realized either by personifying no part at all of the parcel, or by one of the senders personifying his printed paper and the other senders being allowed to include their printed papers more or less as appendices without any personification. In order to make the direct mail advertising effective, it is, however, desired that one turns personally to the addressee, and this may also be of importance as far as the statistic follow-up of the result of the direct mail advertising is concerned. If it is desired to prepare with present methods for preparing parcels for direct mail advertising, individual personally addressed printed papers for the individual senders and then to put such printed papers into a common envelope for several senders, the costs will, however, be so high that they are not reasonably related to the result that can be expected.

OBJECT OF THE INVENTION

The invention provides a completely new idea as far as direct mail advertising is concerned by which it is intended to produce printed papers for several different senders, which are personified with regard to the addressee, by a rational method in preparing parcels for direct mail advertising of the kind referred to above, so that the costs for the individual senders can be kept at a reasonable level.

SUMMARY OF THE INVENTION

According to one aspect of the invention, the novel features of the method mentioned above are those defined as follows: Method in preparing parcels for direct mail advertising to several addressees, comprising the steps of preparing for each individual addressee an envelope addressed to said addressee; preparing for each individual addressee a set of a predetermined number of individual and separate printed papers, all of the same size, said papers of each set having different senders and the number of said papers being the same for all addressees; printing on each of the printed papers of each individual set of said prepared sets information personified with regard to the actual addressee; putting all printed papers of each set one upon the other; stacking said sets after printing of said information; picking each set as a whole from the top of the stack thus formed; and enclosing each picked set into the envelope addressed to the addressee personified on the printed papers in the set.

According to one aspect of the invention, the novel features of the method mentioned above are those defined as follows: Method in preparing parcels for direct mail advertising to several addressees, comprising the steps of preparing for each individual addressee an envelope addressed to said addressee; preparing for each individual addressee a set of a predetermined number of individual and separate printed papers, all of the same size or of somewhat different sizes, said papers of each set having different senders and the number of said papers being the same for all addressees or of different numbers of papers for the various addressees; printing on each of the printed papers of each individual set of said prepared sets information personified with regard to the actual addressee; putting all printed papers of each set one upon the other; stacking said sets after printing of said information; picking each set as a whole from the top of the stack thus formed: and enclosing each picked set into the envelope addressed to the addressee personified on the printed papers in the set.

Yet another aspect of the matter resides broadly in a method in preparing parcels for direct mail advertising, comprising the steps of: preparing for each individual addressee a set of a predetermined number of individual and separate printed papers of one and the same size, the number being the same for all addressees; printing information personified with regard to the actual addressee on each printed paper of one and the same set; putting all printed papers of each set one upon the other; stacking the sets picking each set as a whole from the stack thus formed: and enclosing each picked set into an envelope addressed to the addressee personified in each set.

BRIEF DESCRIPTION OF THE DRAWINGS

In order to explain the invention in more detail reference is made to the accompanying drawings, in which.

DESCRIPTIONS OF THE PREFERRED EMBODIMENTS

Figure 1:
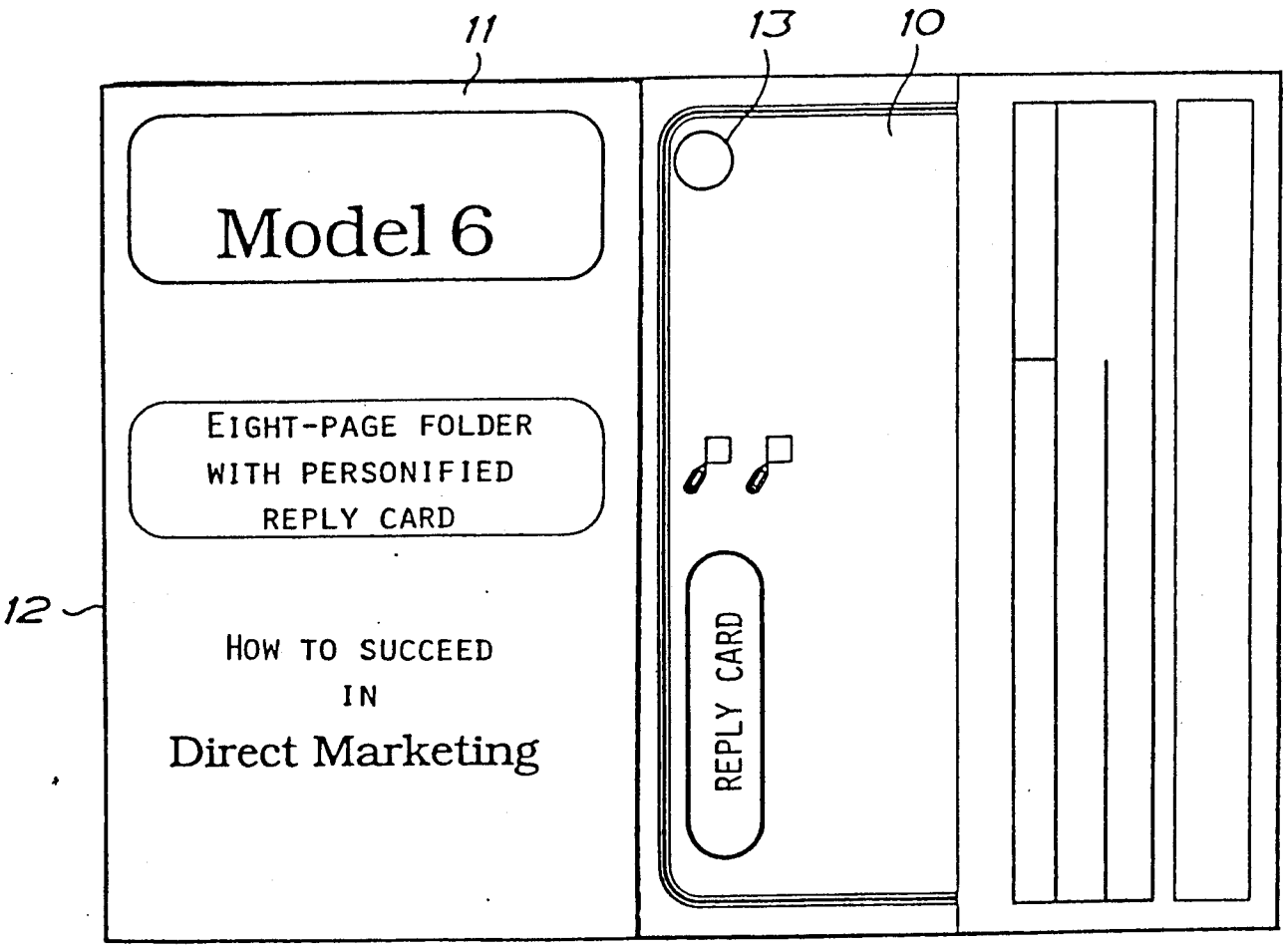
FIG. 1 is a plan view of one embodiment of a printed paper which can be used when applying the method of the invention.

The printed paper disclosed in FIG. 1 comprises a major portion 10 having a few sheets, for example two sheets, and a minor portion 11, comprising several sheets of smaller size than that of portion 10 and being integral with this portion at an edge 12. The major portion 10 can comprise a personified answer-back card or answer-back envelope, personified discount tickets or a personified order form, while the minor portion 11 comprises a folder containing the advertising message and possibly trading stamps, hidden offer or the like. In the portion 10, there is provided a circular aperture 13, preferably of a size of the order of 10 mm, in the proximity of the portion 11.

Figure 2:
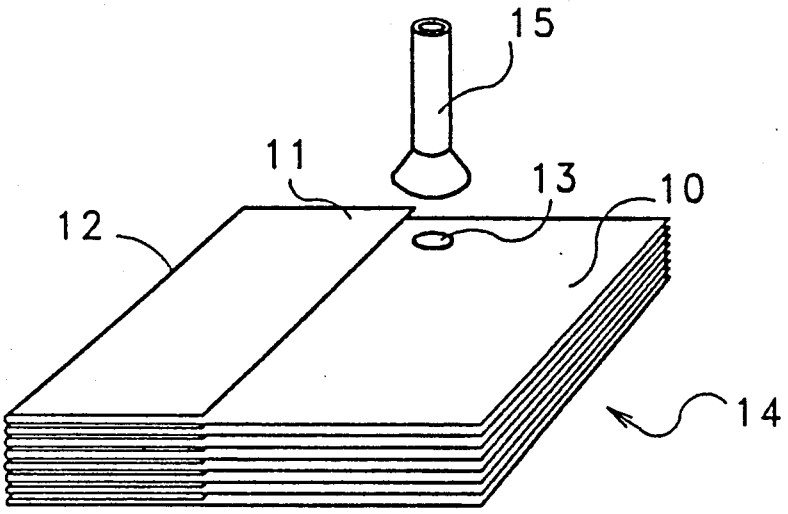
FIG. 2 is a perspective view of a set of printed papers according to FIG. 1 to be included in one and the same parcel.
Figure 3:
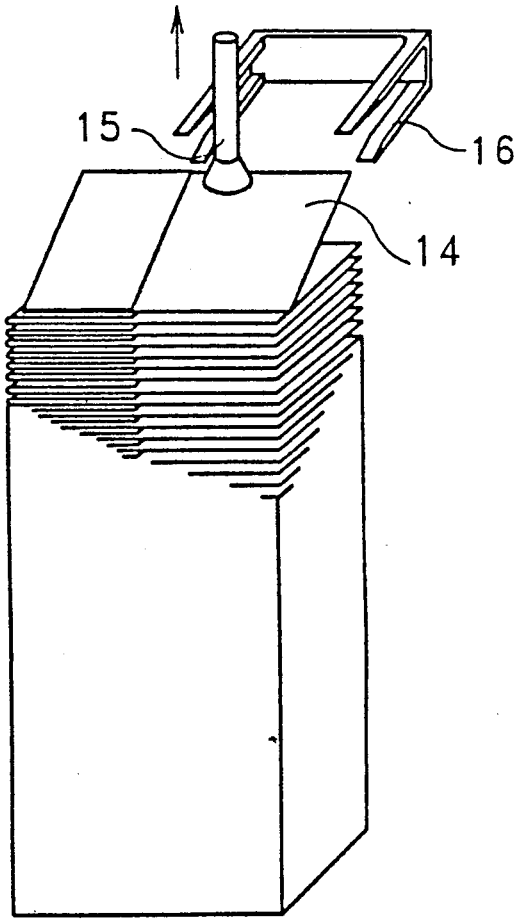
FIG. 3 is a stack of such sets of printed papers.

If there shall be included into each direct mail advertising parcel printed papers according to FIG. 1 from e.g., eight senders, these eight papers personified with regard to one and the same addressee, i.e., the name of the addresse appears on some part of the printed paper and possibly also the address of the addressee, these printed papers are laid together to form a set 14, FIG. 2, wherein all printed papers except the lowermost one has the aperture 13, these apertures being located in the same position on all printed papers and thus are in register. The sets for several different addressees—they may be thousands—are stacked without the order of the individual sets being changed. The stack is shown in FIG. 3. There are machines which produce from one sheet all printed papers to be included into a set of the construction shown in FIG. 1 and deliver these sets arranged as mentioned above in a stack according to FIG. 3, for example, the enveloping machine marketed by Bell & Howell, U.S.A.

The individual sets are now picked from the stack one by one by the uppermost set 14 of the stack being separated from the rest of the stack in a manner known per se through German Patent DECC-486120 by engaging a vacuum gripper 15 with the uppermost printed paper of the uppermost set in the region of the aperture 13 said gripper attracting by suction the lowermost printed paper in said set because the negative pressure will act on said lower-most printed paper through the registering apertures 13 in the printed papers laying thereon, such that said latter printed papers will be clamped between the lowermost printed paper and the vacuum gripper. The set which has been gripped then can be handled by suitable handling means 16 known per se, so as to transfer the set to a window envelope addressed to the addressee personified on the printed papers of the set by the uppermost printed paper of the set. By this method of picking the sets, it is guaranteed that the printed papers will not be intermixed by the printed papers of one set being put into the same envelope of another set. Rational handling which may approach or generally reach 100% safety as far as the insertion of correct printed papers in one and the same envelope is concerned will be achieved by applying the method of the invention. Generally, 100% safety is reached even over long periods of operation of an enveloping machine operating in accordance with embodiments of the invention.

An example of the type of enveloping machine marketed by Bell & Howell, supra., is the Bell & Howell Phillipsburg 10000 High Production Envelope Inserting Machine. The Bell & Howell Phillipsburg 10000 machine is sold by Bell & Howell at least at their facility having the address of: 33–35 Woodthorpe Road, Ashford, Middlesex TW15 2RZ, United Kingdom. This is just an example of one of the machines in which embodiments of the present invention could be utilized.

Some examples of enveloping or insertion machines are disclosed in the following publications and patents: Bell & Howell brochure number P.10000/0188/UK and in other Bell & Howell brochures, instruction manuals and repair manuals; U.S. Pat. No. 4,798,040, entitled Insertion Machine: U.S. Pat. No. 4,784,379, entitled Apparatus and Method for Automated Mail: U.S. Pat. No. 4,639,873, entitled Insertion Machine with Postage Categorization and Selective Merchandising; U.S. Pat. No. 4,580,772, entitled Hopper Feeder Apparatus Method.

A short synopsis of the invention is described as follows: One embodiment of the invention relates to a method in preparing parcels for direct mail advertising to several addressees, comprising the steps of preparing for each individual addressee an envelope addressed to said addressee; preparing for each individual addressee a set of a predetermined number of individual and separate printed papers, all of the same size, said papers of each set having different senders and the number of said papers being the same for all addressees; printing on each of the printed papers of each individual set of said prepared sets information personified with regard to the actual addressee; putting all printed papers of each set one upon the other; stacking said sets after printing of said information; picking each set as a whole from the top of the stack thus formed; and enclosing each picked set into the envelope addressed to the addressee personified on the printed papers in the set.

Another embodiment of the invention relates to a method in preparing parcels for direct mail advertising comprising the steps of preparing for each individual addressee a set (14) of a predetermined number of individual and separate printed papers of one and the same size, the number being the same for all addressees; printing information personified with regard to the actual addressee on each printed paper of one and the same set; putting all printed papers of each set one upon the other; stacking the sets; picking each set as a whole from the stack thus formed; and enclosing each picked set into an envelope addressed to the addressee personified in each set.

A further embodiment of the invention relates to a method comprising the step of arranging each printed paper with a portion (10) having one sheet or a few sheets of said size, and a portion (11) having several sheets of a smaller size than the first mentioned portion and being integral with said portion at one of the edges (12) thereof.

Yet another embodiment of the invention relates to a comprising of the steps of punching an aperture (13) in all printed papers except one of each set in one and the same position of the printed papers, locating the printed paper having no aperture at the bottom when all printed papers of each set are laid one upon the other, and engaging a vacuum gripper (15) with the uppermost printed paper of a set in the region of the punched aperture, to pick up the set from the stack.

An additional embodiment of the invention relates to a method wherein punching of said aperature (13) is performed in the portion (10) having one sheet or a few sheets.

In summation, the invention relates to a method in preparing parcels for direct mail advertising comprising printed papers from several different senders in one and the same envelope. For each individual addressee there is provided a set of a predetermined number of individual and separate printed papers of one and the same size, the number being the same for all sets. Each printed paper of one and the same set is provided with printed information personified as regards the actual addressee.

All printed papers of a set are laid one upon the other and then all sets are stacked. Each set is picked in its entirety from the stack, and each set thus picked is inserted into an envelope addressed to the addressee personified in the set.

All of the patents, patent applications, and publications recited herein, if any, are hereby incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. Method in preparing parcels or envelopes for direct mail advertising to several addressees, comprising the steps of:

preparing for each individual addressee an envelope addressed to said addressee;

preparing for each individual addressee a set of a predetermined number of individual and separate printed papers, all of substantially the same size, said papers of each set having different senders and the number of said papers being substantially the same for all addressees;

printing on each of the printed papers of each individual set of said prepared sets information personified with regard to the actual addressee;

putting all printed papers of each set one upon the other:

stacking said sets after printing of said information:

picking each set as a whole from the top of the stack thus formed; and enclosing each picked set into the envelope addressed to the addressee personified on the printed papers in the set.

2. Method in preparing parcels or envelopes for direct mail advertising, comprising the steps of:

preparing for each individual addressee a set of a predetermined number of individual and separate printed papers of one and the same size, the number being substantially the same for all addressees;

printing information personified with regard to the actual addressee on each printed paper of one and the same set;

arranging each printed paper with a portion having one sheet or few sheets of said size, and a portion having several sheets of a smaller size than the first mentioned portion and being integral with said portion at one of the edges thereof;

putting all printed papers of each set one upon the other;

stacking the sets;

picking each set as a whole from the stack thus formed; and enclosing each picked set into an envelope addressed to the addressee personified in each set.

3. Method as in claim 2 wherein punching of said aperture is performed in the portion having one sheet or a few sheets.

4. Method as in claim 2 further comprising the steps of:

punching an aperture in all printed papers except one of each set in one and the same position of the printed papers, locating the printed paper having no aperture at the bottom when all printed papers of each set are laid one upon the other, and engaging a vacuum gripper with the uppermost printed paper of a set in the region of the punched aperture to pick up the set from the stack.

5. Method as in claim 2 further comprising the steps of:

punching an aperture in all printed papers except one of each set in one and the same position of the printed papers, locating the printed paper having no aperture at the bottom when all printed papers of each set are laid one upon the other, and engaging a vacuum gripper with the uppermost printed paper of a set in the region of the punched aperture to pick up the set from the stack.

6. Method as in claim 5 wherein punching of said aperture is performed in the portion having one sheet or a few sheets.

7. Method as in claim 4 wherein punching of said aperture is performed in the portion having one sheet or a few sheets.

* * * * *